United States Patent [19]

Slavin

[11] Patent Number: 4,468,545

[45] Date of Patent: Aug. 28, 1984

[54] ELECTRICAL SWITCH FOR AUTOMOBILE DECK LID LATCHES AND THE LIKE

[75] Inventor: Michael Slavin, Troy, Mich.

[73] Assignee: Lectron Products, Inc., Rochester, Mich.

[21] Appl. No.: 423,137

[22] Filed: Sep. 24, 1982

[51] Int. Cl.[3] ..... H01H 3/00

[52] U.S. Cl. ..... 200/61.64; 200/283

[58] Field of Search ..... 200/61.62, 61.64, 61.67, 200/283, 1 A; 70/241, 61, 66

[56] References Cited

U.S. PATENT DOCUMENTS

| | | | |
|---|---|---|---|
| 3,297,849 | 1/1967 | Rapata | 200/283 |
| 3,588,414 | 6/1971 | Prickett | 200/283 |
| 3,917,330 | 11/1975 | Quantz | 292/216 |
| 4,322,959 | 4/1982 | Mochida | 200/61.64 |

*Primary Examiner*—Joseph W. Hartary
*Assistant Examiner*—Morris Ginsburg
*Attorney, Agent, or Firm*—Harness, Dickey & Pierce

[57] ABSTRACT

An electrical switch having general utility but intended primarily for use in automotive vehicles. The switch comprises a case and one or more terminal blades and is readily adaptable for a variety of different environmental conditions. The case and the blades are uniquely formed and correlated so that the case effectively insulates each blade from the others and from adjacent metallic parts of the vehicle, so that the components can be quickly and easily assembled and for inexpensive manufacture. Each blade is cantilevered from the case to provide a soft action that results in a relatively long life but at the same time maintains a good electrical connection with a compatible switch part.

10 Claims, 8 Drawing Figures

ELECTRICAL SWITCH FOR AUTOMOBILE DECK LID LATCHES AND THE LIKE

STATEMENT OF THE INVENTION

This invention relates to new and useful improvements in electrical switches.

BACKGROUND AND SUMMARY OF THE INVENTION

By way of example, switches of the type involved may be mounted on the latch mechanism that holds the trunk or deck lid of an automotive vehicle closed to operate the light with which the trunk area of the vehicle conventionally is equipped and sometimes also to control an indicator light that is mounted on the instrument panel of the vehicle to let the driver know when the deck lid is unlatched. In order to function in this manner, the switch is mounted in some convenient location where it is operated by the latch or striker cam each time the latter is operated to release or open the deck lid. When the deck lid is open, the switch is closed to turn on the trunk light and, in the alternative arrangement, to illuminate the bulb on the instrument panel to apprise the driver that the deck lid is released and the trunk is open. On the other hand, when the deck lid is closed and latched, the switch is disengaged to open the circuit to the trunk light so that the latter is extinguished and, in the alternative situation, also to open the circuit that serves the instrument panel light so that the latter also is extinguished to let the driver known that the deck lid is closed and latched.

Manifestly, in the suppositious situation described above, the striker cam conventionally is snapped open with considerable force by a relatively strong torsion spring. Consequently, the switch of this invention is struck with a correspondingly great force each time the deck lid is opened and this occurs innumerable times during the life of the vehicle. Accordingly, the switch must be designed and constructed to withstand the physical abuse and rough treatment to which it is subjected in use over long periods of time. At the same time, the switch must be small in size and adaptable to many different environmental conditions. Moreover, in order to be competitive in the marketplace, the switch must be inexpensive to manufacture and easy to install.

In view of the foregoing circumstances, it is an important object of the present invention to provide an electrical switch that has relatively few parts so that it is easy to assemble and inexpensive to manufacture and that, additionally, is physically relatively small in size and readily adaptable to a variety of different environmental conditions.

Another object of the invention is to provide an electrical switch in which the case and the terminal blade or blades mounted thereon are uniquely formed and correlated so that each blade has an essentially soft, springy and resilient action that permits it to absorb the relatively heavy impact forces to which it is subjected in use and to have a correspondingly long life.

Still another object of the invention is to provide an electrical switch of the above mentioned character in which the case can be equipped with a plurality of terminal blades and wherein the blades are uniquely combined and correlated with each other and with the case so that the actuated, contact-making ends of the blades are arranged side-by-side for mutual actuation by a single movement of an actuating part and so that the opposite ends of the blades that are connected in the electrical circuitry of the vehicle can be disposed one above the other if desired for convenience in making the connection.

Other advantages of the present invention will become apparent from a consideration of the following detailed description taken in connection with the accompanying drawings.

DETAILED DESCRIPTION OF THE PREFERRED EMBODIMENTS

Figure 1:
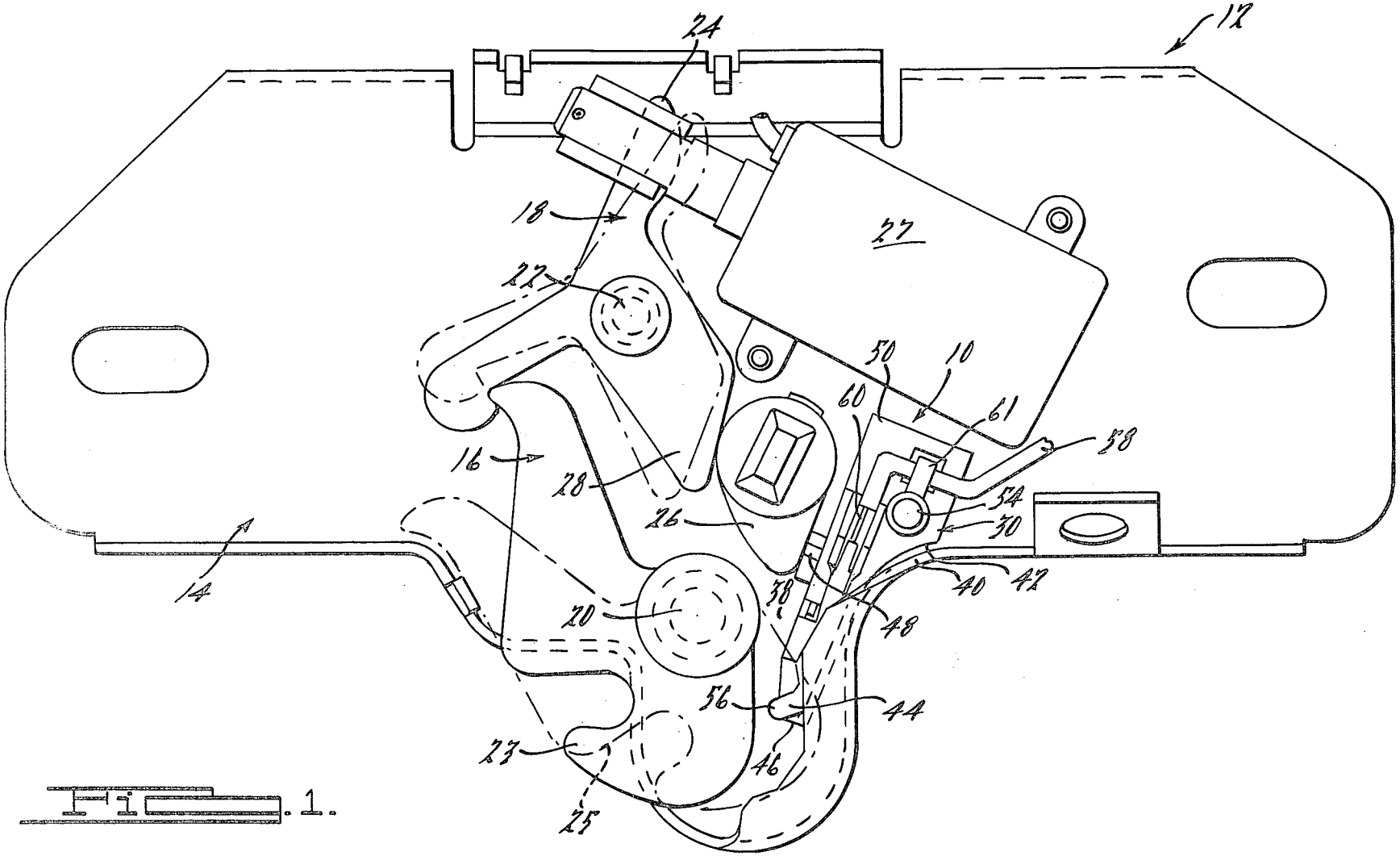
FIG. 1 is a plan view showing an electrical switch embodying the invention having a case equipped with a single terminal blade mounted on a typical automotive deck lid latch mechanism and in operative association with an actuating part of the mechanism which, in this instance, is the striker cam or latch member with which these devices typically are equipped.

Reference is first had to FIG. 1 which shows an electrical switch 10 embodying the invention mounted on a typical latch mechanism 12 for the deck lid of an automotive vehicle (not shown) and in operative association with the striker cam or latch member of the mechanism. The particular latch mechanism here shown by way of example is similar to the one shown and described in detail in U.S. Pat. No. 3,917,330, dated Nov. 4, 1975, and owned by the same assignee as the present application. Accordingly, the disclosure of this patent is incorporated by reference in this application; and resort may be had to the patent document for a detailed description and understanding of the latch mechanism and its operation in use. Suffice it to say for the purpose of this application that the basic parts of the latch mechanism 12 comprise a mounting plate 14, usually made from sheet metal by conventional stamping and forming operations, and spring loaded striker and catch cams 16 and 18 attached to the plate by pivots 20 and 22, respectively.

In practice, the base mounting plate 14 is bolted or otherwise attached and electrically grounded to the deck lid of an automotive vehicle adjacent to the outer or swinging edge thereof according to conventional practice. When the deck lid is open, the striker cam 16 and the catch cam 18 are in the broken line positions shown in the drawings, and when the deck lid is closed, the striker cam and the catch cam are in the full line positions. When the deck lid is shut, a striker bolt (not shown) attached to a fixed part of the vehicle body engages the edge 25 of the striker cam 16, which as suggested at that time is in the broken line position, and turns the striker cam clockwise on its pivot 20, as viewed in the drawing, against the action of a torsion spring (not shown) to engage the end 23 of the striker cam around the striker bolt to hold the deck lid securely closed. At the same time, the catch cam 18 is turned automatically counterclockwise on its pivot 22, as shown in the drawing, by a spring (not shown) to engage and interlock with the striker cam (FIG. 1) to hold the latter in positive engagement with the striker bolt and to positively prevent the striker cam from releasing the bolt and inadvertently permitting the deck lid to open. When it is desired to open the deck lid, the catch cam 18 is turned on the pivot 22 in a clockwise direction, as viewed in the drawing, to disengage the striker cam so that the torsion spring, not shown but referred to above, can turn the striker cam on the pivot 20 to the broken line position. Disengagement of the catch cam 18 from the striker cam 16 conventionally is accomplished either by a solenoid 27 operatively associated with the upwardly projecting arm portion 24 of the catch cam or by a key-actuated cam member 26 conventionally mounted for rotative or oscillatory movement on the base mounting plate 14 in operative association with the portion 28 of the catch cam.

Figure 2:
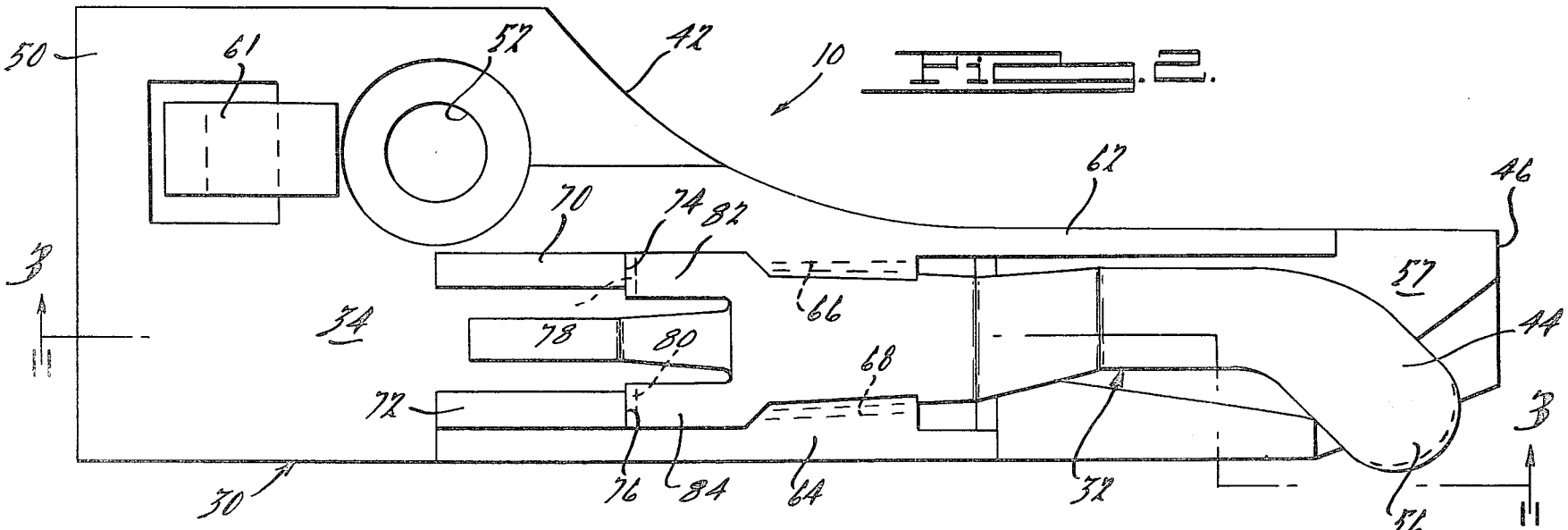
FIG. 2 is an enlarged plan view illustrating the case portion of the switch assembly shown in FIG. 1 and a single terminal blade assembled with the case.
Figure 3:
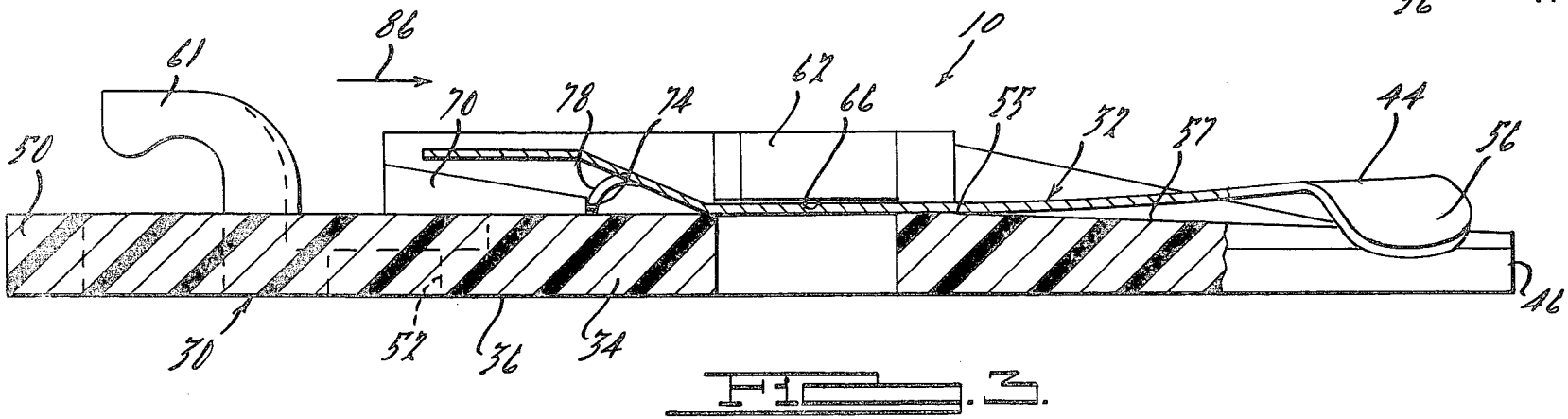
FIG. 3 is a longitudinal partial sectional view taken on the line 3—3 of FIG. 2.

The form of electrical switch 10 shown in FIGS. 1–3 comprises a case 30 and a single terminal blade 32.

The case 30 preferably is made of a suitable electrically insulating plastic material, such as nylon or the like, that can be molded relatively inexpensively to a desired shape and that retains its physical shape and dimensions within relatively close tolerance limits under normal conditions of use. The particular case 30 here shown is relatively elongate in plan (FIG. 2), and it is formed with a base portion 34 having a flat bottom seating surface 36 that rests on and solidly engages a flat mounting surface 38 of corresponding size and shape provided on the base mounting plate 14 (FIG. 1) in laterally spaced relation but adjacent to the striker cam 16. In the particular form of base mounting plate 14 here shown by way of illustration, the plate is formed with a curved, upstanding flange 40 at one side of the striker cam (FIG. 1), and the base portion 34 of the case 30 is formed with a correspondingly curved edge 42 that fits snugly against the flange 40 to assist in locating and holding the switch bodily properly with respect to the striker cam 16.

The terminal blade 32 also is of generally elongate configuration in plan and it overlaps and is supported by the base portion of the case 30 with the forward end portion 44 thereof substantially coterminous with the corresponding end 46 of the case.

The case 30 is held laterally against or in predetermined laterally spaced relation with respect to the mounting plate flange 40 by a tab 48 that is struck and bent upwardly from the plate at the side of the case opposite the curved edge 42. Also, the case 30 is provided adjacent to the rearward end 50 thereof with an opening 52 that extends downwardly through the base 34 and that registers with a similar size opening (not shown) in the mounting plate 14 when the switch 10 is properly positioned on the mounting surface 38. In practice, the tab 48 is spaced from the mounting plate flange 40 so that the case 30 is press fitted at assembly between the tab and the flange to locate the case laterally on the mounting surface 38; and, when the case is positioned longitudinally to align the hole 52 with the companion hole in the mounting plate 14, the forward end 46 of the case and the forward end 44 of the terminal blade 32 are both properly positioned precisely with respect to the striker cam 16.

During assembly of the switch 10 on the mounting plate 14, the case 30 with the terminal blade 32 assembled thereon is first pressed into position in the manner hereinabove described, and a suitable fastener such as the rivet here shown at 54 is pushed through the hole 52 in the case and the aligned opening in the mounting plate 14, and the projecting end of the rivet is then upset and tightened in the conventional manner to attach the switch securely to the mounting plate.

As perhaps best shown in FIG. 1, the striker cam 16 is disposed entirely to one side of the switch 10 when in the closed or latched position shown by full lines in the drawing; but the lower bolt engaging end 23 of the striker cam overlays the forward end portion 44 of the switch blade 32 when the striker cam is in the open or unlatched broken-line position. In this connection, it will be readily appreciated that the bolt engaging end 23 of the striker cam 16 is spaced sufficiently above the switch mounting surface 38 so that it clears the underlying forward end 46 of the case 30 when it moves from the closed full-line position to the open broken-line position. However, the forward end 44 of the terminal blade 32 is spaced sufficiently above the underlying base portion 34 of the case 30 so that it is electrically isolated by the base portion from the electrically grounded mounting plate 14 but lies in the path of travel of the striker cam 16 which of course is electrically connected to the mounting plate. Thus, as the striker cam 16 moves from the closed full-line position to the open broken-line position it engages the end portion of the terminal blade. It is desirable that the striker cam 16 depress and override the terminal blade 32; and, to this end, the forward end portion 56 of the blade 32 is formed to extend angularly forwardly and downwardly as best shown in FIG. 3 to define a beveled ramp surface that lies in a plane substantially parallel to the adjacent edge of the striker cam as the latter moves angularly about the pivot 20 to the blade-engaging position. Consequently, as the striker cam 16 moves from the full-line to the broken-line position, the lower end thereof impinges against and overrides the ramp end 56 of the terminal blade 32; and, as it does so, it depresses the engaged end of the blade so that the resilient action of the latter causes it to bear upwardly against the striker cam with sufficient force to establish and maintain a good electrical connection therebetween.

A wire 58 forming part of the electrical circuit that includes the trunk light (not shown) is clamped or otherwise securely attached to the rearward end of the terminal blade 32, as indicated at 60, so that engagement of the striker cam 16 with the terminal blade 32 closes a circuit through the trunk light and turns the latter on to illuminate the trunk area. Preferably, the wire 58 coming off the connection 60 is press fitted under a wire retainer 61 formed integrally with the case 30 to relieve the connection 60 from undue stress and strain in use. The terminal blade 32 may be made of any suitable electrically conductive metallic material such as beryllium or a suitable beryllium alloy that is sufficiently durable to withstand repeated actuation by the striker cam 16 preferably for the life of the vehicle of which it is a part without fracture or permanent deformation thereof and that will provide a good electrical connection when in engagement with the striker cam.

The manner in which the terminal blade 32 is combined and correlated with the case 30 to permit quick and easy assembly of the blade and the case and to position the forward end of the blade precisely with respect to the striker cam 16 when the case is assembled on the base mounting plate 14 in the manner hereinabove described is an important feature of the invention. To this end, the case 30 is formed at opposite longitudinal sides thereof with upstanding, generally parallel flanges 62 and 64, and the inner sides of the flanges are provided with opposed longitudinal slots or ways 66 and 68 that receive and snugly fit opposite marginal side edge portions of the blade 32 at substantially the middle of the latter. Also, the case 30 is formed at the rearward end 50 thereof with a pair of laterally spaced abutments 70 and 72 forming forwardly facing stops 74 and 76, respectively, disposed to be engaged at final assembly of the case and the blade 32 by downwardly bent end portions 78 and 80 of longitudinally rearwardly extending spring arms 82 and 84 formed on the blade at opposite sides of the connection 60. As perhaps best shown in FIG. 2, the slots 66 and 68 are formed with a slight forward taper and the middle portion of the blade 32 that fits in the slots has correspondingly tapered edges so that, when the blade is pushed into the slots from the rear as indicated by the arrow 86, the blade tightens against the bottoms of the slots as the forward end of the blade reaches the desired final position on the case 30; and, as the blade 32 is pressed forwardly in the slots, the shoulder defining ends of the spring arms 82 and 84 simultaneously snap into position in front of the abutments 70 and 72 to seat rearwardly against the stops 74 and 76 so as to prevent the blade from retracting in the slots. In fact, the spring arms 82 and 84 may be flexed as they snap into place so that the shoulder defining ends thereof embed themselves at least slightly into the stops 74 and 76 and the resilient action of the arms thereafter hold the embedded ends in interfitting relation with the abutments 70 and 72 to hold the parts securely together. In addition, the top surface 57 of the base portion 34 tapers forwardly from about the forward ends of the slots 66 and 68 and the portion of the blade 32 extending forwardly from the slots is bent angularly upwardly so that the base defines a fulcrum edge at about the location shown at 55 in FIG. 3 about which the blade flexes when energized by the striker cam 16 and so that the blade is cantilevered forwardly of the edge 55 to assure ample clearance between the blade and the case. Also, because of the long cantilever thus afforded, the operational portion of the terminal blade 32 extending forwardly of the fulcrum edge 55 provides a desirable soft action in the operation of the switch that permits the blade to readily absorb the sharp, abrupt impact forces imposed on it by the striker cam 16 when the latter is snapped open by the torsion spring previously referred to. This soft action of the terminal blade in turn is a significant factor in the achievement of the desirably long life that characterizes the instant switch even under the rough conditions and abuse to which it is subjected in use.

Since the assembly of the switch involves only two parts; viz., the case 30 and the terminal blade 32, the assembly operation can be performed easily and quickly and if desired it can be accomplished by suitable automatic means. As indicated previously, both the case 30 and the blade 32 can be mass produced inexpensively by conventional injection molding operations in the one instance and by conventional stamping and forming operations in the other. Consequently, the complete switch is inexpensive to manufacture. Furthermore, after the two parts of the switch have been assembled in the manner hereinabove described, the two spring arms 82 and 84 define stops or shoulders that mutually cooperate with the abutments 70 and 72 to hold the blade securely assembled with the case; and, because of the constant pressure exerted by the spring arms 82 and 84 through the end portions 78 and 80 of the arms against the stops 74 and 76, the blade is not readily separated from the case under any conditions of use including repeated actuation thereof over long periods of time by the striker cam 16. Throughout the life of the switch, the case 30 effectively insulates the blade 32 from the metallic parts of the latch mechanism 12 and the side flanges 62 and 64 serve a double function in this regard since they not only help position the blade but they also help isolate the blade electrically from its environment.

Figure 4:
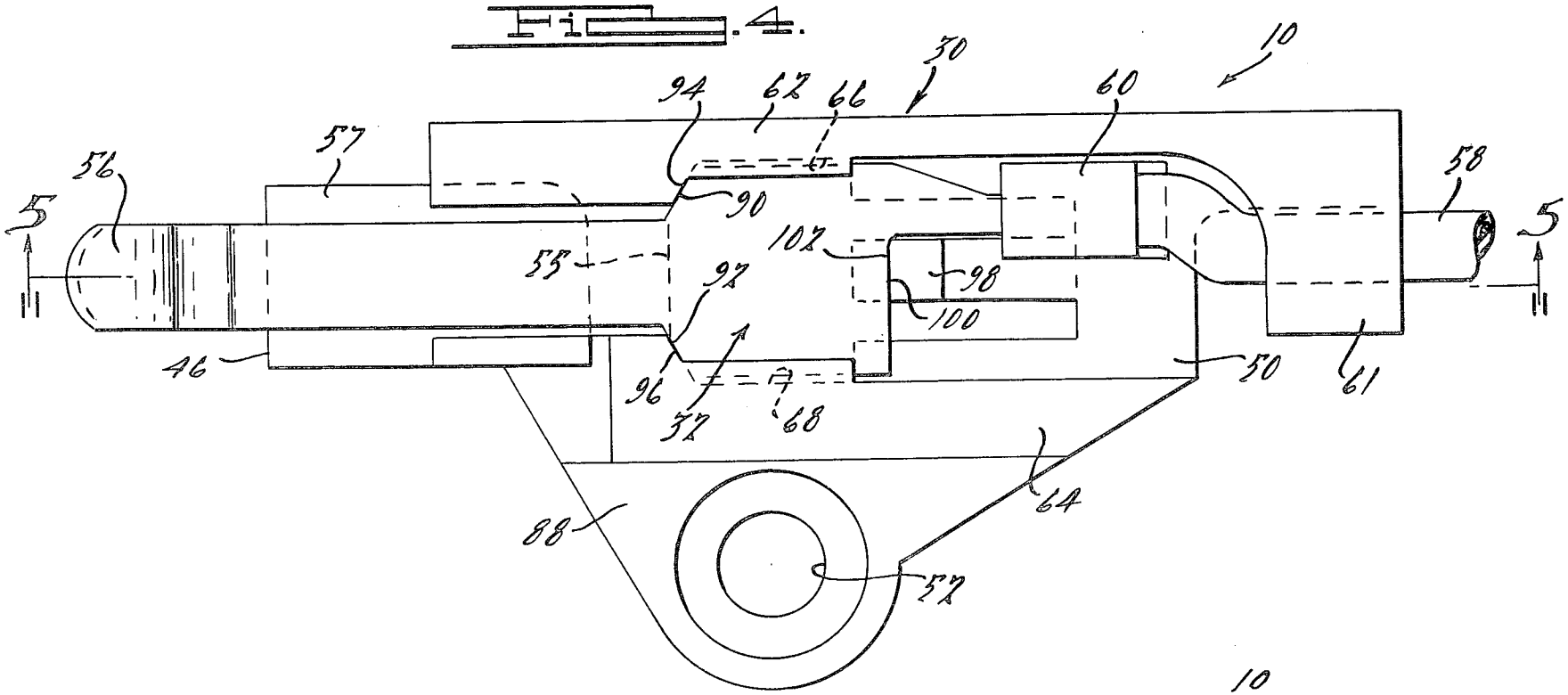
FIG. 4 is a plan view of a modified switch assembly embodying the invention in which the case also is equipped with a single terminal blade.
Figure 5:
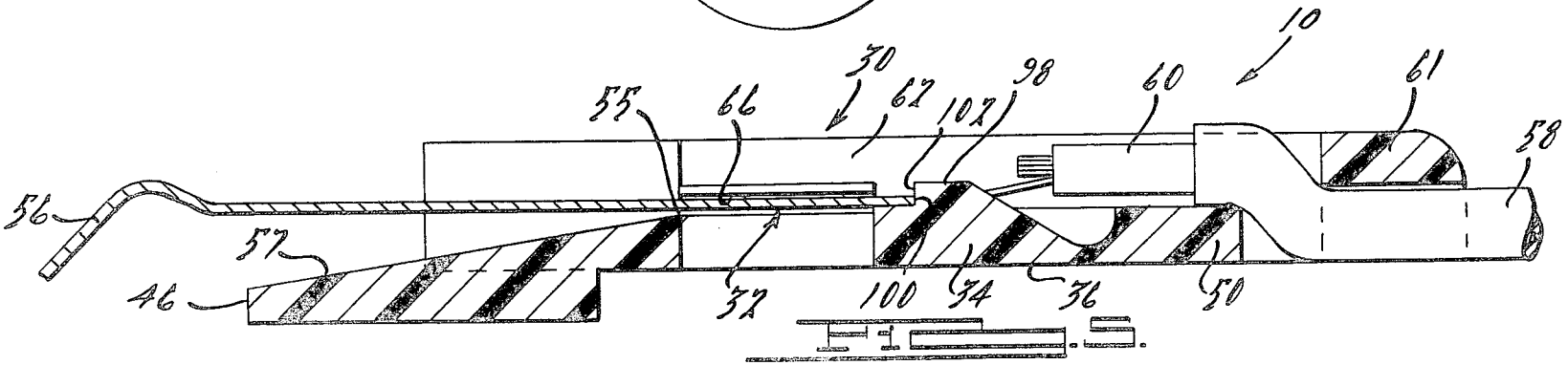
FIG. 5 is a longitudinal sectional view taken on the line 5—5 of FIG. 4.

Reference is now had to FIGS. 4 and 5 which show a modified form of the invention that is generally similar to the form first described but that differs therefrom in several significant respects. In view of the rather extensive similarities, however, the same reference numbers are used to identify corresponding parts of the modification if they perform the same function in the same way even though they may differ slightly in shape or physical dimensions and additional or new reference numerals are used to identify those parts that are different.

First off, it should perhaps be noted that the modification shown by FIGS. 4 and 5 comprises the same basic combination of case 30 and terminal blade 32 and that, when the modification is used in the environment shown by way of example in connection with the form of the invention first described, the case 30 is adapted to be mounted on and attached to the base mounting plate 14 of the latch mechanism 12 substantially in the same manner as in the first form of the invention and that the terminal blade is adapted for actuation by the striker cam 16 of the latch mechanism substantially as shown and described for the first form of the invention. To this end, the case 30 shown in FIG. 4 is formed with a lateral extension, designated generally by the numeral 88, that has an opening 52 for reception of a rivet or other suitable fastening means for attaching the case to the mounting plate 14.

Also, the case 30 shown in FIG. 4 is formed at opposite sides thereof with longitudinal upstanding, electrically insulating flanges 62 and 64 having confronting longitudinal slots or grooves 66 and 68 at the inner sides thereof that slidably receive and interfit with the middle portion of the terminal blade 32. In the modified form of the invention, however, the slots or ways 66 and 68 are not forwardly tapered as in the first form of the invention but are generally parallel to each other.

In order to limit forward movement of the terminal blade 32 in the ways 66 and 68, the flanges 62 and 64 are formed at the inner sides thereof and at the forward ends of the ways with transverse stops 90 and 92 against which are seated correspondingly disposed transverse shoulders 94 and 96 provided on the blade. In the particular form of the invention here shown by way of illustration, the stops 90 and 92 and the shoulders 94 and 96 are tapered forwardly and inwardly to exert a wedging action on the blade in the final longitudinal position of the latter on the case 30. Because of the elastic but penetrable nature of the material from which the case 30 is made, the taper permits at least some slight longitudinal adjustment of the blade position after initial engagement of the shoulders 94 and 96 with the stops 90 and 92 by forward pressure exerted on the terminal blade 32 to force the shoulders against the stops.

The case 30 is formed at substantially the middle thereof with an upstanding abutment 98, and the abutment is spaced longitudinally with respect to the stops 90 and 92 so as to be behind the transverse rearward edge 100 of the middle portion of the terminal blade 32 when the latter is at the extreme forward position on the case 30 permitted by the interengaging stops 90, 92 and shoulders 94, 96. In fact, the abutment 98 is strategically located so that, when the terminal blade 32 is in the extreme forward position, the edge 100 is disposed proximate to the front face 102 of the abutment. In fact, it is desirable that there be at least some slight overlap of the blade 32 and the abutment 98 when the blade first contacts the stops 90 and 92 so that some forward pressure against the blade and penetration of the shoulders 94 and 96 into the stops is required to permit the blade to be pressed downwardly in the direction of the case to engage the edge 100 with the front face of the abutment. When these relationships obtain, the taper of the stops 90 and 92 continues to maintain at least a slight pressure between the edge 100 and the abutment 98 to hold the terminal blade 32 in secure assembly with the case 30. This rearward pressure of the stops 90 and 92 is augmented by the nature of the material from which the case 30 is made, particularly when it is made from nylon as suggested above or any similar elastic or resilient material having a memory that causes it to try to resume its original shape after deformation. In any event, the abutment 98 prevents rearward movement of the terminal blade 32 after the latter has been positioned longitudinally on and fully assembled with the case 30, and the abutment 98 thereafter prevents retraction of the blade on the case due to engagement of the striker cam 16 with the blade or to contact by other means that may exert a similar force on the blade in use.

It will be observed further that the top surface of the case 30 disposed forwardly of the ways 66 and 68 and of the rearwardly facing stops 90 and 92 is forwardly tapered or beveled as at 57 so that it diverges from the cantilevered portion of the terminal blade 32 (FIG. 5). Consequently, the terminal blade 32 flexes about a fulcrum edge 55 similarly to the first form of the invention with the same advantages.

Attention is further directed to the fact that the forward end portion 56 of the terminal blade 32 is inclined forwardly and downwardly in generally the same manner as the corresponding portion of the terminal blade described in connection with the first form of the invention. Accordingly, the inclined end portion 56 defines a ramp surface against which the striker cam 16 impinges when it is snapped open by the torsion spring previously referred to. Consequently, the striker cam 16 imposes a wedging force on the terminal blade 32 as it overrides the latter with the result that the latter is flexed downwardly about the fulcrum edge 55. This fact, together with the fact that the cantilevered portion of the blade 32 extending forwardly of the fulcrum edge 55 is relatively elongate, assures a soft action of the blade in use and all of the advantages attending this feature described in detail in connection with the first form of the invention.

Figure 6:
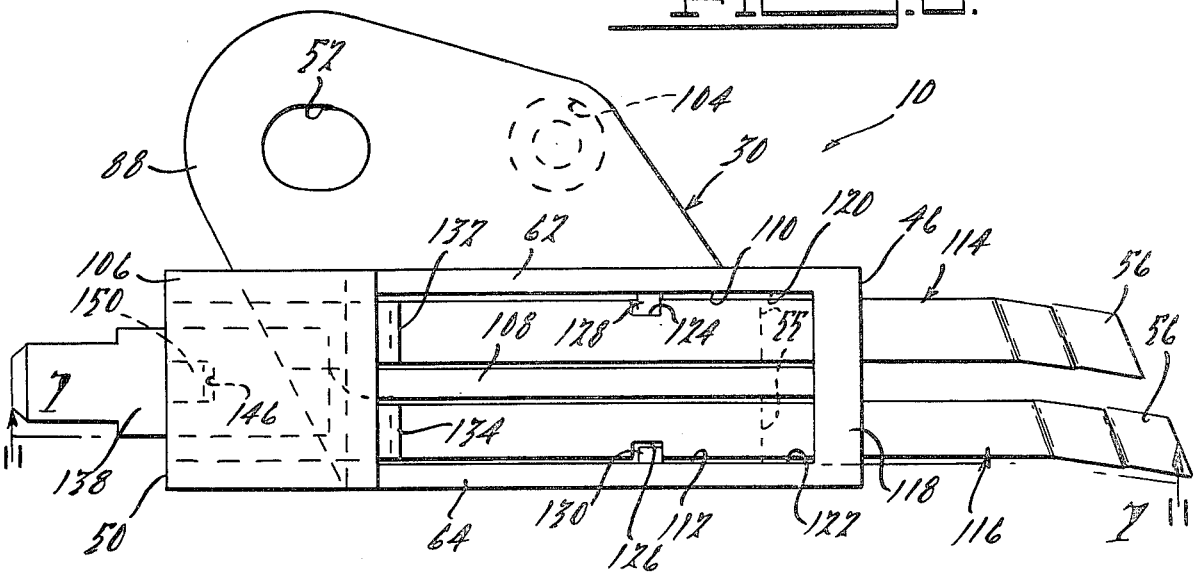
FIG. 6 is a plan view showing another modified form of the invention in which the case is equipped with a plurality of—specifically two—terminal blades.
Figure 7:
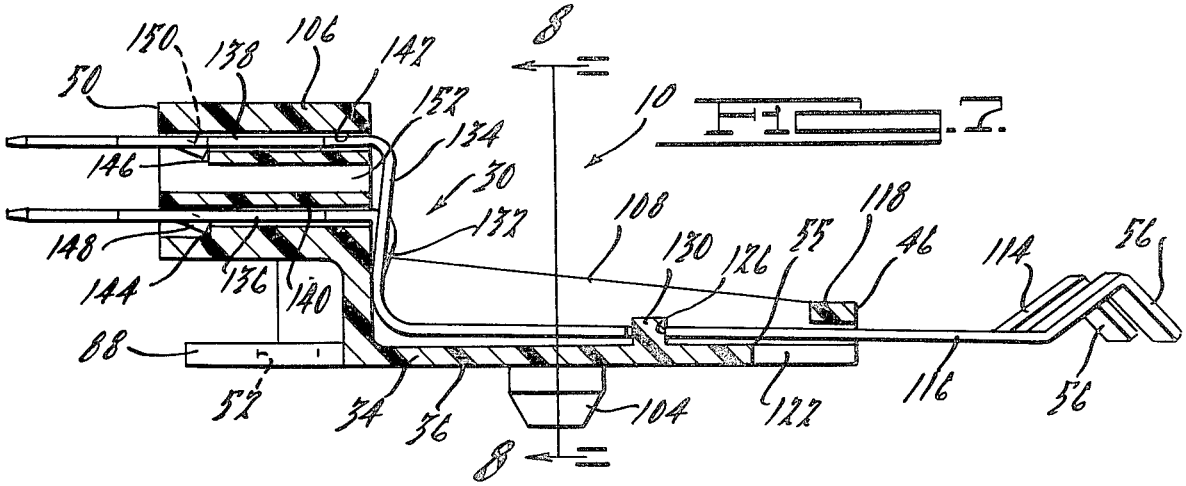
FIG. 7 is a longitudinal sectional view taken on the line 7—7 of FIG. 6.
Figure 8:
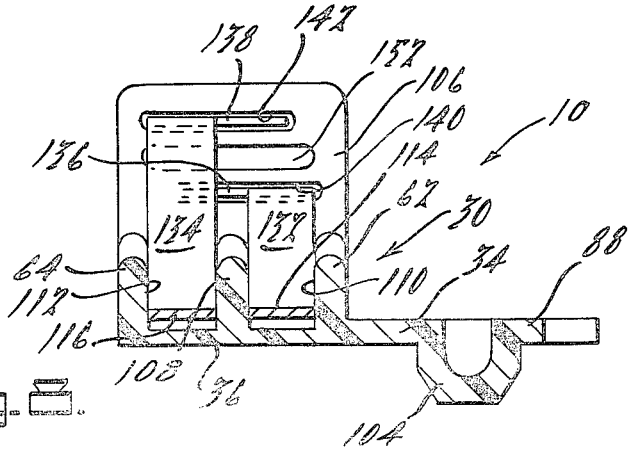
FIG. 8 is a transverse sectional view taken on the line 8—8 of FIG. 7.

Reference is now had to FIGS. 6, 7 and 8 which show still another modified form of the invention that is primarily adapted and preeminently suited for switches that require more than one terminal blade. The particular switch here shown by way of illustration is provided with two terminal blades 114 and 116 one of which is adapted to be connected in the trunk light circuit in the same manner and for the same purpose as the terminal blades of the two switch constructions shown in FIGS. 1–3 and FIGS. 4 and 5, respectively. The other terminal blade of the switch shown in FIGS. 6–8 is adapted to be connected in a second circuit in series with an indicator light on the instrument panel of the vehicle that is adapted to be illuminated when the latch mechanism is operated to release the deck lid to apprise the driver of the vehicle that the deck lid is unlatched and the trunk is open.

Here again the portions of the switch shown in FIGS. 6–8 that are the same or similar to corresponding portions of the two switch constructions previously described are identified by the same numerals, and it will be readily appreciated that the advantages attributable to the structural portions and features that are common to these various switch constructions and described in detail in connection therewith, apply equally to the second modified switch construction now under consideration. In the latter, the case 30 includes a base portion 34 that has a flat bottom seating surface 36 suitable for mounting on a latch mechanism in the manner previously described, and the case also is formed with a lateral extension 88 similar to the first modified form of the invention that has an opening 52 for reception of a rivet or similar fastener used to attach the case securely to the base mounting plate 14 of a latch mechanism 12 in operative association with the striker cam 16 of the mechanism. In addition, however, the laterally extending portion 88 of the case 30 is provided, in the form of the invention involved here, with a depending stud 104 that is adapted to be piloted in a snugly fitting opening (not shown) in the mounting plate 14 to locate the switch relatively precisely with respect to the striker cam 16.

The case 30 of the second modification differs from the cases of the two forms of the invention previously described in that the rearward portion thereof is provided with an upward extension 106 that preferably is integral with the case and defines a rear blade retainer means. Also, the case 30 of the second modification is provided with a third longitudinal upstanding flange 108 that extends substantially midway between the two side flanges 62 and 64 to define a pair of laterally spaced, parallel, longitudinal channels 110 and 112 in the forward portion of the case ahead of the upward extension 106. These two channels 110 and 112 open upwardly through the top of the case 30 and are adapted to receive the two terminal blades 114 and 116. The three flanges 62, 64 and 108 extend above the terminal blades 114 and 116 when the latter are seated in the bottoms of the channels 110 and 112 and the forward ends of the flanges are interconnected by a transverse retainer bar 118 that overlays the terminal blades when the latter are so disposed. Openings 120 and 122 provided in the bottoms of the channels 110 and 112 at the forward ends thereof and behind the retainer bar 118, permit insertion of the terminal blades 114 and 116 into the channels from the forward end of the case 30.

At assembly of the terminal blades 114 and 116 with the case 30, the blades 114 and 116 are inserted into the channels 110 and 112 upwardly and rearwardly through the openings 120 and 122 from below the case and, as the blades enter the channels the rearward portions thereof are tipped downwardly into the channels and simultaneously pushed rearwardly until they are in the fully inserted position and seated on the base portion of the case that forms the bottoms of the channels. Notches or recesses 124 and 126 in the outer side edges of the terminal blades 114 and 116 accept and interfit with lugs 128 and 130 formed integrally with and at the sides of the outer flanges 62 and 64, as perhaps best shown in FIG. 6. Thus, the interfitting notches 124, 126 and lugs 128, 130 position the terminal blades 114 and 116 essentially precisely longitudinally in the channels 110 and 112 and also prevent longitudinal movement of the blades in the channels after assembly thereof with the case 30.

In the final assembled positions of the terminal blades 114 and 116, the forward portions thereof extend a substantial distance beyond the front end of the case 30 so that the rearward ends of the openings 120 and 122 define fulcrum edges 55 about which the projecting portions of the blades flex in use. In this connection, it will be observed that the forward portions of the terminal blades 114 and 116 are cantilevered from the fulcrum edges 55 and that the portions of the blades disposed forwardly of the fulcrum edges are relatively longitudinally elongate to assure a soft flexing action when the forward cantilevered portions of the blades are flexed downwardly about the fulcrum edges 55 to provide the advantages attending this feature described in detail in connection with the first forms of the invention.

The rearward portions of the terminal blades 114 and 116 that connect into the wiring circuits of the vehicle referred to above extend upwardly at the rear of the channels 110 and 112 as shown at 132 and 134, respectively, and thence rearwardly as at 136 and 138 generally parallel to the forward portions of the blades. Thus, the rearward portions of the terminal blades 114 and 116 are upwardly offset with respect to the forward portions thereof; and, in the particular form of the invention here shown by way of illustration, the rearward portion 138 of the blade 116 is offset farther than the rearward portion 136 of the blade 114. Very often, and perhaps most often, the rear portions 136 and 138 of the blades 114 and 116 can best be adapted to wiring plug connections of the type conventionally or most often used in automotive vehicles if these portions are spaced vertically with respect to each other rather than horizontally in the manner of the forward cantilevered portions of the blades. On the other hand, it will be readily apparent that the forward cantilevered portions of the terminal blades 114 and 116 must be disposed side-by-side in the same horizontal plane when the switch is used in combination with a trunk latch. The construction of the switch shown in FIGS. 6–8 is uniquely adapted for this purpose.

If the rear wire-connecting-portions 136 and 138 of the terminal blades 114 and 116 are adapted for push-in connection with a conventional female plug, it is of course desirable that these portions be secured or fixed so that they cannot move longitudinally. To this end, the rearwardly extending portions 136 and 138 are projected through longitudinal parallel passages or slots 140 and 142 of corresponding shape in cross section provided in the upward extension 106 of the case 30 when the blades 114 and 116 are moved to their final position in the channels 110 and 112 and the rearward portions of the passages are recessed at the undersides thereof to define stops 144 and 146 against which are seated flexible and resilient tabs 148 and 150 that are struck and bent downwardly from the blades. When the rearward portions 136 and 138 of the terminal blades 114 and 116 are pushed rearwardly through the passages 140 and 142, the tabs 148 and 150 flex so as to pass readily through the passages; however, as soon as the tabs move past the stops 144 and 146 they snap downwardly and seat forwardly against the stops to prevent or at least inhibit forward movement or retraction of the rear portions 136 and 138 in the passages 140 and 142. In other words, the tabs 148 and 150 acting in conjunction with the stops 144 and 146 provide snap fastener means for preventing forward movement of the rear portions 136 and 138 of the terminal blades 114 and 116 with respect to the case 30 and they also, acting in conjunction with the recesses 124, 126 and lugs 128, 130 assist in preventing forward bodily movement of the blades in the channels 110 and 112.

In the particular form of the invention here shown, a relatively larger through passage 152 is provided in the upward extension 106 substantially midway between the two passages 140 and 142 to facilitate injection molding of the case 30, but the passage 152 serves no other useful purpose in the construction or operation of the switch.

As in the form of the invention first described, the forward ends of the terminal blades 114 and 116 are inclined forwardly and downwardly for proper cooperation and coaction with the striker cam 16; and, since the latter is disposed at the same side of the switch as the blade 114 and turns angularly about the pivot 20, the cantilevered forward portion of the blade 114 is shorter than the corresponding portion of the blade 116 so that the striker cam engages the inclined ramp portions 56 of the blades at about the same time.

Ideally, the rearward plug connecting portions 136 and 138 of the terminal blades 114 and 116 are disposed one directly above the other. Consequently, the two slots 140 and 142 are similarly disposed and the rearwardly extending portions 136 and 138 of the terminal blades 114 and 116 are laterally offset in opposite directions so that they align properly with the passages 140 and 142 and with each other. It will be readily apparent, however, that if the female plug with which the switch is adapted to be connected is formed with laterally spaced terminal connections, the rearward extensions 136 and 138 of the switch can be readily positioned in this manner or indeed in any other configuration required to adapt it for any particular form or kind of female plug.

Manifestly, the modified switch construction shown by FIGS. 6–8 has all of the significant structural features described in detail in connection with the forms of the invention first described, and these structural features function in the same way to achieve the same beneficial results as the corresponding features in the first forms of the invention. Consequently, a detailed recitation of these features and of these benefits would be merely repetitious and need not be repeated here.

While it will be apparent that the invention herein described is well calculated to achieve the benefits and advantages as hereinabove set forth, it will be appreciated that the invention is susceptible to modification, variation and change without departing from the spirit thereof.

Having thus described the invention, I claim:

1. An electrical switch adapted to be mounted on a primary supporting member having a switch mounting surface and to be mechanically engaged by and to have a wiping electrical contact with an associated switch actuating part forming part of an electrical circuit and having a back and forth movement adjacent to said mounting surface, said switch comprising a case having a bottom seating surface adapted to be supported on the mounting surface of said primary member and to be fastened to the latter in a predetermined position with respect to said switch actuating part;

a plurality of parallel, longitudinal channels in the forward portion of the case opening through the top thereof and through the bottoms of said channels at the forward ends of the latter;

means forming transverse retainer bars at the forward ends of said channels above said bottom openings;

blade retainer means carried by said case rearwardly of said channels; and a plurality of elongate, flexible and resilient terminal blades, one for each of said channels, each of said blades having a forward position and a rear terminal portion and being insertable into its respective channel through the bottom opening of the latter and being longitudinally slidable in said channel into engagement with said blade retainer means;

the forward portions of said terminal blades extending under and beyond said transverse retaining bars and in the path of travel of said switch actuating part when said case is mounted on and fastened to said primary supporting member, whereby said transverse retaining bars limit upward movement of said blades in said channels and cooperate with said blade retainer means to hold said blades in said channels, the rearward ends of said bottom openings defining bearing edges for said blades and the forward portions of said blades being cantilevered from said bearing edges for free, normally unsupported and restricted downward flexing movement about said bearing edges, whereby said switch actuating part engages and overrides the cantilevered forward portions of said blades in use to flex the same downwardly about said bearing edges with a soft action that results in a relatively long life for the switch and at the same time provides an effective electrical contact between the blade and said switch actuating part.

2. An electrical switch according to claim 1 wherein the rear terminal end portions of said blades project beyond said blade retainer means and define electrical terminals behind said case adapted for connection with compatible terminals forming part of an electrical circuit.

3. An electrical switch according to claim 1 wherein said blade retainer means extends upwardly from said case behind said channels, and wherein said blades are provided with upwardly offset rear terminal portions movable into engagement with said blade retainer means by longitudinal movement of said blades in said channels.

4. An electrical switch according to claim 2 wherein said blade retainer means is integral with and a part of said case and is formed with a plurality of longitudinal ways therein, and wherein the rear terminal portion of each blade extends through and is in interfitting engagement with a respective one of said ways.

5. An electrical switch according to claim 4 wherein said ways comprise individual openings spaced different distances above said channels and disposed vertically in alignment with each other, and wherein the rear terminal portions of said blades extend through and project from said openings.

6. An electrical switch according to claim 1 including means for holding said blades in predetermined longitudinally fixed positions in said channels.

7. An electrical switch according to claim 6 wherein the means for holding said blades longitudinally fixed in said channels includes snap fastener means engageable automatically to position said blades when the latter reach predetermined longitudinal positions in said channels.

8. An electrical switch according to claim 6 wherein said means for holding said blades longitudinally fixed in said channels comprises means interacting between said blades and said case engageable automatically to hold said blades when the latter reach predetermined longitudinal positions in said channels.

9. An electrical switch according to claim 4 wherein the rearward terminal portions of said blades and said blade retainer means are spaced different distances above said channels, whereby the forward terminal portions of said blades are spaced horizontally with respect to each other and the rear terminal portions of said blades are spaced vertically with respect to each other.

10. An electrical switch according to claim 9 wherein at least certain of the rearward terminal portions of said blades are offset horizontally to position said rear terminal portions collectively in vertical alignment with each other.

* * * * *

UNITED STATES PATENT AND TRADEMARK OFFICE

CERTIFICATE OF CORRECTION

PATENT NO. : 4,468,545

DATED : August 28, 1984

INVENTOR(S) : Michael Slavin

It is certified that error appears in the above-identified patent and that said Letters Patent is hereby corrected as shown below:

Column 1, line 31, "known" should be -- know --.

Column 11, line 21 (Claim 1), "position" should be -- portion --.

Signed and Sealed this

*Twelfth* Day of *February 1985*

[SEAL]

*Attest:*

DONALD J. QUIGG

*Attesting Officer* *Acting Commissioner of Patents and Trademarks*